US011253968B2

(12) United States Patent
Chalfant et al.

(10) Patent No.: US 11,253,968 B2
(45) Date of Patent: Feb. 22, 2022

(54) ADJUSTABLE SHARPENER

(71) Applicant: Smith's Consumer Products, Inc., Hot Springs, AR (US)

(72) Inventors: Louis Chalfant, Hot Springs, AR (US); Ricky L. Dukes, Knoxville, TN (US)

( * ) Notice: Subject to any disclaimer, the term of this patent is extended or adjusted under 35 U.S.C. 154(b) by 738 days.

(21) Appl. No.: 16/058,188

(22) Filed: Aug. 8, 2018

(65) Prior Publication Data

US 2020/0047303 A1 Feb. 13, 2020

(51) Int. Cl.

| | |
|---|---|
| ***B24B 3/54*** | (2006.01) |
| ***B24B 3/36*** | (2006.01) |
| ***B24D 15/06*** | (2006.01) |
| ***B24D 15/08*** | (2006.01) |

(52) U.S. Cl.

CPC ..... *B24B 3/54* (2013.01); *B24B 3/36* (2013.01); *B24D 15/06* (2013.01); *B24D 15/08* (2013.01)

(58) Field of Classification Search

CPC .. B24B 3/36; B24B 3/54; B24B 3/543; B24D 15/02; B24D 15/06; B24D 15/063; B24D 15/065; B24D 15/08; B24D 15/081; B24D 15/085; B24D 15/087

USPC ..... 451/45, 349, 552, 555, 556

See application file for complete search history.

(56) References Cited

U.S. PATENT DOCUMENTS

| | | | | |
|---|---|---|---|---|
| 1,909,743 | A * | 5/1933 | Blankner | B24D 15/081 451/486 |
| 2,249,218 | A | 7/1941 | Meade et al. | |
| 2,262,401 | A * | 11/1941 | Meade | B24D 15/081 451/486 |
| 2,683,385 | A | 7/1954 | Murchison | |
| D276,884 | S | 12/1984 | Carter | |
| D277,166 | S | 1/1985 | Call | |
| 4,494,340 | A | 1/1985 | Carter | |
| D304,153 | S | 10/1989 | Reichow | |

(Continued)

FOREIGN PATENT DOCUMENTS

| | | |
|---|---|---|
| AU | 201816637 | 12/2018 |
| CA | 183435 | 6/2019 |

(Continued)

OTHER PUBLICATIONS

Extended European Search Report, European Patent Application No. 18275143.8 (dated Feb. 27, 2019).

(Continued)

*Primary Examiner* — Eileen P Morgan

(74) *Attorney, Agent, or Firm* — Richard Blakely Glasgow

(57) ABSTRACT

An adjustable sharpener including a body having two sharpening slots, a first arm with a first abrasive element connected to a second arm with a second abrasive element, and a third arm with a third abrasive element connected to a fourth arm with a fourth abrasive element. The first and second abrasive elements are positioned in the first sharpening slot, and the third and fourth abrasive elements are positioned in the second sharpening slot. The adjustable sharpener also includes an adjuster connected to the body and an adjustment assembly connected to the adjuster, the first arm and the third arm. Linear movement of the adjuster causes rotational movement of the first arm and the third arm. In this regard, the adjuster allows the user to manually increase or decrease the sharpening angle between the abrasive elements in the sharpening slots.

15 Claims, 9 Drawing Sheets

(56) References Cited

U.S. PATENT DOCUMENTS

| | | | | |
|---|---|---|---|---|
| D499,004 | S | 11/2004 | Smith | |
| 7,121,935 | B2 * | 10/2006 | Pretorius | B24D 15/081 451/321 |
| 7,172,500 | B1 * | 2/2007 | Wu | B24D 15/081 451/319 |
| D575,130 | S | 8/2008 | Smith | |
| D654,342 | S | 2/2012 | Cavanaugh | |
| 8,206,199 | B2 | 6/2012 | Smith et al. | |
| 8,221,199 | B2 | 7/2012 | Smith | |
| D680,845 | S | 4/2013 | Smith | |
| D680,846 | S | 4/2013 | Smith et al. | |
| D680,847 | S | 4/2013 | Smith et al. | |
| 8,425,281 | B2 | 4/2013 | Smith et al. | |
| 8,696,407 | B2 | 4/2014 | Dovel | |
| 8,727,836 | B2 | 5/2014 | Smith et al. | |
| 8,944,894 | B2 | 2/2015 | Smith et al. | |
| D730,133 | S | 5/2015 | Sun | |
| 9,333,612 | B2 | 5/2016 | Dovel | |
| 9,358,654 | B1 | 6/2016 | Dovel | |
| D760,573 | S * | 7/2016 | Wang | D8/93 |
| 9,849,556 | B2 | 12/2017 | Dovel | |
| 9,956,662 | B2 | 5/2018 | Dovel | |
| D867,096 | S | 11/2019 | Chalfant | |
| 10,850,369 | B2 * | 12/2020 | Eklund | B24D 15/081 |
| 2003/0171083 | A1 * | 9/2003 | Li | B24D 15/082 451/349 |
| 2004/0014415 | A1 * | 1/2004 | Stallegger | B24D 15/081 451/555 |
| 2004/0198198 | A1 | 10/2004 | Friel | |
| 2006/0040598 | A1 * | 2/2006 | Koppe | B24D 15/081 451/349 |
| 2008/0261494 | A1 | 10/2008 | Friel | |
| 2011/0201257 | A1 | 8/2011 | Walker | |
| 2014/0120812 | A1 * | 5/2014 | Smith | B24D 15/081 451/552 |
| 2018/0056468 | A1 | 3/2018 | Dovel | |

FOREIGN PATENT DOCUMENTS

| | | | |
|---|---|---|---|
| CN | 207824718 | 9/2018 | |
| EP | 005639374-0001 | 9/2018 | |
| GB | 27484 | 5/1911 | |
| GB | 451091 A * | 7/1936 | B24D 15/081 |
| GB | 6043736 | 9/2018 | |
| WO | 2016186567 | 11/2016 | |

OTHER PUBLICATIONS

Office Action, Canadian Patent Application No. 3,017,313 (dated Sep. 25, 2019).
Office Action, Canadian Patent Application No. 3,017,313 (dated May 29, 2020).
Office Action, Auslialian Patent Application No. 2018260867 (dated Oct. 28, 2019).
Office Action, Auslialian Patent Application No. 2018260867 (dated Mar. 2, 2020).
Notice of Acceptance, Auslialian Patent Application No. 2018260867 (dated Jul. 6, 2020).
Certificate of Grant, Australian Patent Application No. 2018260867 (dated Oct. 29, 2020).
Office Action, Canadian Patent Application No. 3,017,313 (dated Dec. 9, 2020).
Commissioner's Notice—Application Found Allowable, Canadian Intellectual Property Office, Canadian Patent Application No. 3,017,313, dated Sep. 24, 2021.

* cited by examiner

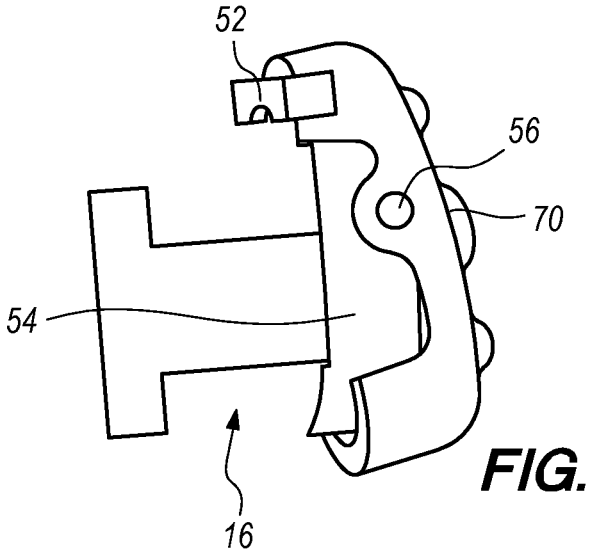
FIG. 11
FIG. 12
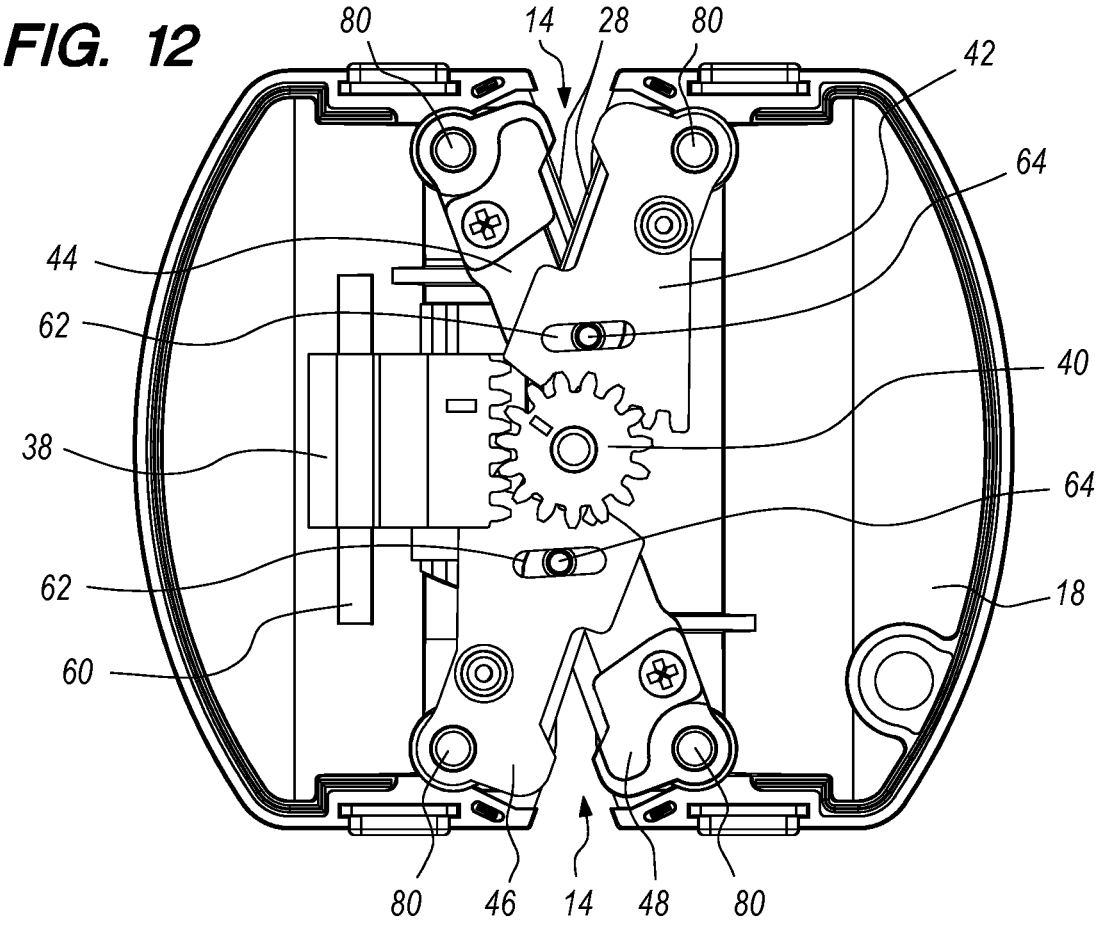

ADJUSTABLE SHARPENER

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

Current adjustable sharpeners are designed to be positioned on a countertop or benchtop, and these sharpeners are often large and heavy. These sharpeners are also relatively long in length because of the orientation of the various components of the sharpeners. It would therefore be desirable to develop an adjustable sharpener that is light and small (i.e. "pocket size").

Current adjustable sharpeners include adjustable arms that have numerous drawbacks. For example, the arms are operated independently of each other. Thus, additional components in the adjustment mechanism are necessary for the arms to operate together and properly. This can also causes problems during operation if the adjustable arms are not timed correctly relative to each other. In addition, the adjustable arms are pivoted near the center of the arms, which results in the abrasive elements lacking adequate support. The adjustable arms therefore are prone to flexing under pressure during sharpening, which decreases sharpening angle accuracy. It would therefore be desirable to develop an adjustable sharpener with adjustable arms that are connected to one another and pivoted from the ends of the adjustable arms to reduce the complexity of the adjustment mechanism and to ensure sharpening angle accuracy.

BRIEF SUMMARY OF THE INVENTION

The present invention is directed to an adjustable sharpener including a body having two sharpening slots, a first arm connected to a first abrasive element, a second arm connected to a second abrasive element, a third arm connected to a third abrasive element, and a fourth arm connected to a fourth abrasive element. The first and second abrasive elements are positioned in said first sharpening slot forming a V-shaped sharpening angle, and the third and fourth abrasive elements are positioned in the second sharpening slot forming a V-shaped sharpening angle. The first arm is connected to the second arm via a pin in slot connection, and the third arm is connected to the fourth arm via a pin in slot connection. The adjustable sharpener also includes an adjuster connected to the body and an adjustment assembly connected to the adjuster, the first arm and the third arm. Linear movement of the adjuster causes rotational movement of the first arm and the third arm. In this regard, the adjuster allows the user to manually increase or decrease the sharpening angle between the abrasive elements in the sharpening slots. In an alternative embodiment, the adjustable sharpener includes only one sharpening slot. In that embodiment, the adjustable sharpener requires only the first arm and the second arm and not the third arm or fourth arm.

These and other features, objects and advantages of the present invention will become better understood from a consideration of the following detailed description of the preferred embodiments and appended claims in conjunction with the drawings as described following:

BRIEF DESCRIPTION OF THE DRAWINGS

FIG. 11 is a side perspective view of the adjuster of one embodiment of the adjustable sharpener.

FIG. 12 is a back view of the inner components of one embodiment of the adjustable sharpener with the second piece of the body removed and the rack at a middle position on the track.

DETAILED DESCRIPTION OF THE INVENTION

Figure 1:
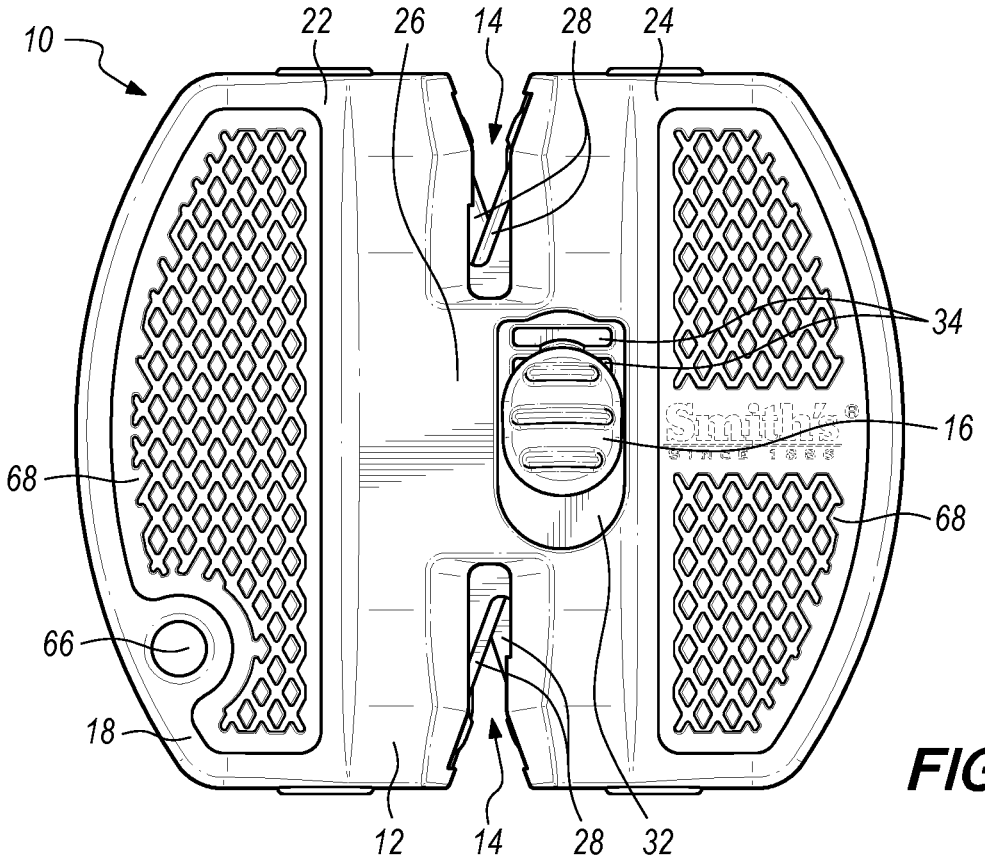
FIG. 1 is a front view of one embodiment of the adjustable sharpener.
Figure 2:
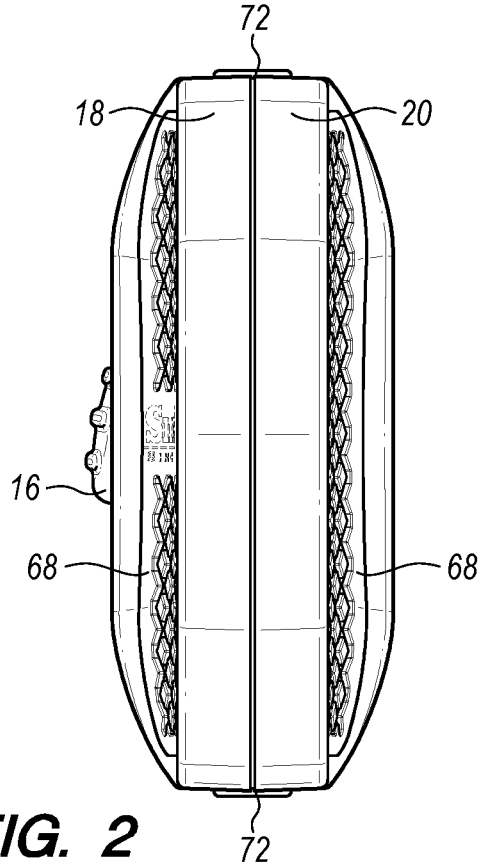
FIG. 2 is a right side view of one embodiment of the adjustable sharpener.

With reference with FIGS. 1-15, the preferred embodiments of the adjustable sharpener 10 of the present invention may be described. The sharpener 10 is comprised of a body 12, one or more sharpening slots 14 containing abrasive elements 28 (e.g. carbide abrasive blades or ceramic abrasive rods) for sharpening a tool having a cutting edge (e.g. knife), and an adjuster 16 attached to the body 12 to manually change the sharpening angle between the abrasive elements 28. The body 12 is the exterior of the sharpener 10 and preferably includes a first piece 18 (such as the front or top piece) and a second piece 20 (such as the back or bottom piece). Both the first piece 18 and the second piece 20 of the body 12 are comprised of a first section 22, a second section 24 and an adjoining section 26. In one embodiment, as shown in FIG. 1, the exterior shape of the first section 22 is a mirror image of the exterior shape of the second section 24. The first section 22 and the second section 24 are joined by the adjoining section 26, which may be generally square or rectangular shaped. The two pieces 18, 20 of the body 12 are roughly H-shaped because the length of the adjoining section 26 is less than the lengths of the first section 22 and the second section 24. The first piece 18 and the second piece 20 of the body 12 are connected to each other at their ends, as shown in FIG. 2. The first piece 18 and the second piece 20 of the body are preferably fastened or bonded together. Two feet 72 are secured between the tops of the first piece 18 and the second piece 20, and two additional feet 72 are secured between the bottoms of the first piece 18 and the second piece 20. In one embodiment shown in FIG. 3, the first piece 18 and the second piece 20 of the body 12 include indentions to receive the four end caps 72. The non-skid feet 72 contact a surface when the sharpener is in use and ensure that the sharpener does not slip on the surface during use.

Figure 3:
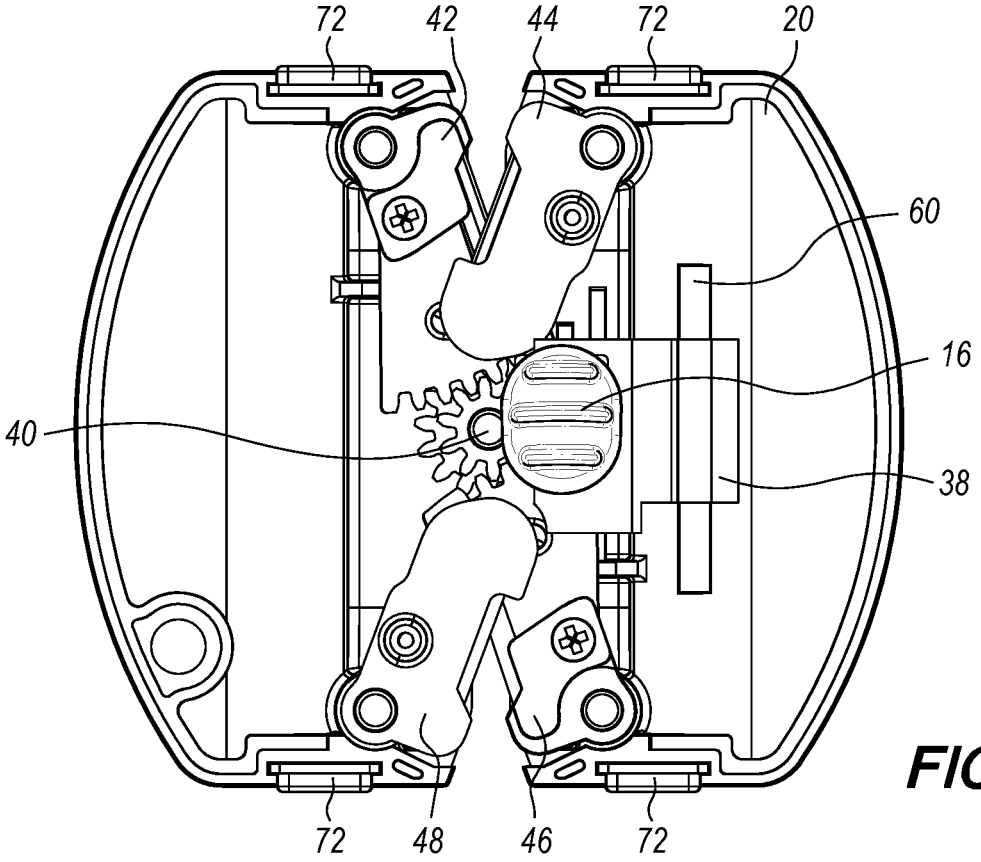
FIG. 3 is a front view of the inner components of one embodiment of the adjustable sharpener with the first piece of the body removed.

The spaces formed between the first section 22, the second section 24 and the adjoining section 26 are the sharpening slots 14, as shown in FIGS. 1 and 3. A pair of abrasive elements 28 is positioned in each of the sharpening slots 14 to form a V-shaped sharpening angle. The blade of the tool is pulled across the abrasive elements 28 in the slots 14 for sharpening.

As shown in FIG. 1, an adjuster 16 is attached to the first piece 18 of the body 12. The adjuster allows the user of the sharpener 10 to manually adjust the relative positioning of the pair of abrasive elements 28 in each of the sharpening slots 14. In other words, the adjuster 16 operates to adjust the sharpening angle between the pair of abrasive elements 28 exposed in the sharpening slots 14. The adjuster 16 is positioned between the sharpening slots 14. This orientation of the adjuster 16 and the sharpening slots 14 yields a smaller sharpener compared to current adjustable sharpeners.

Figure 8:
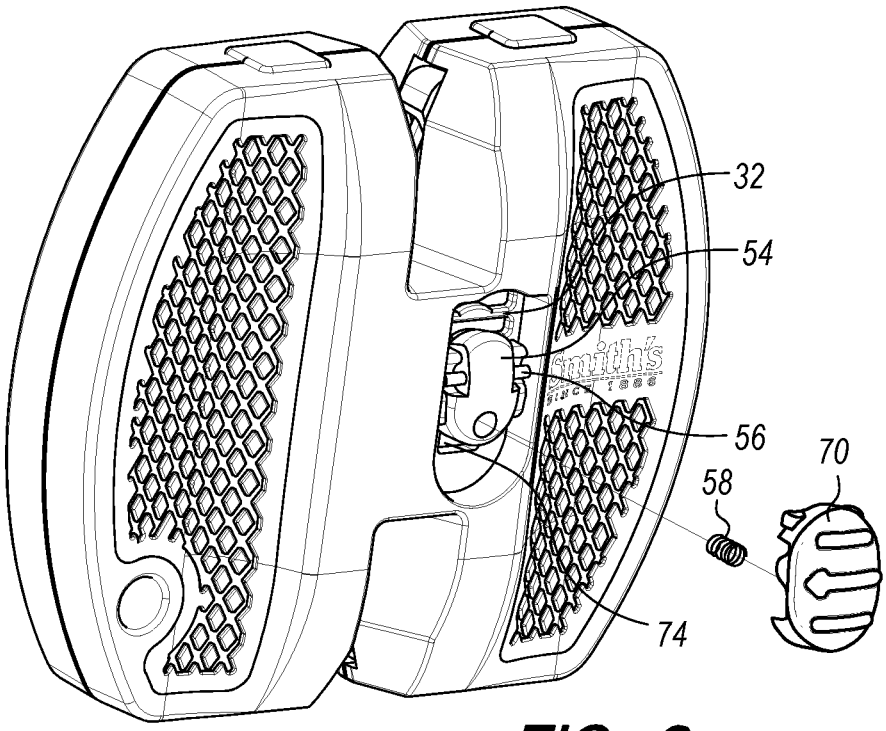
FIG. 8 is front perspective view of the first piece of the body of one embodiment of the adjustable sharpener with the adjuster in an exploded view.
Figure 9:
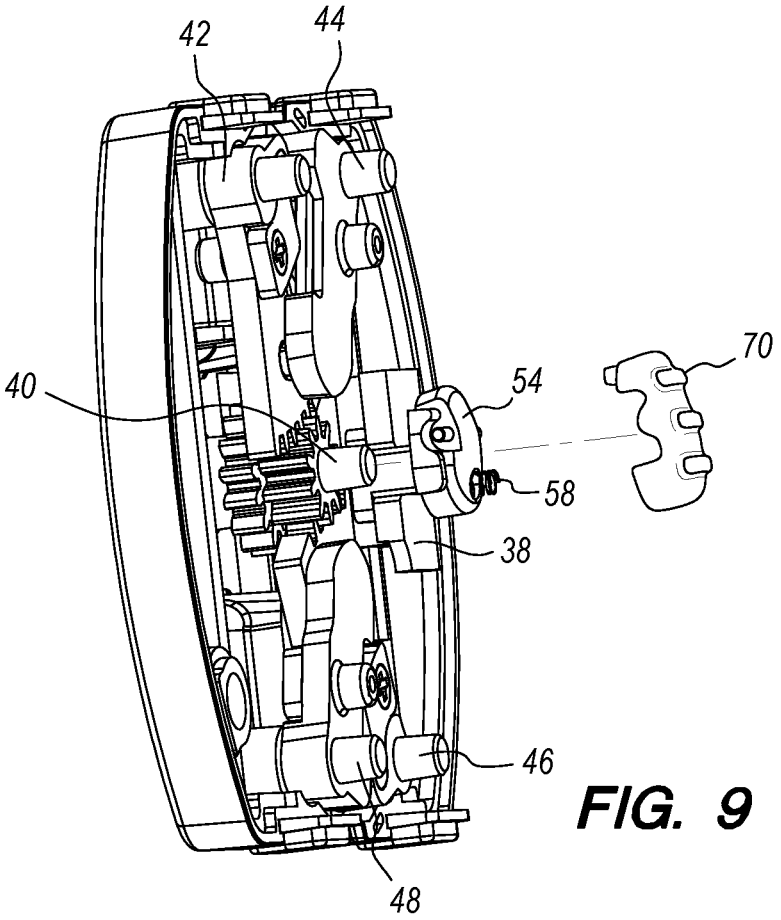
FIG. 9 is a side perspective view of the inner components of one embodiment of the adjustable sharpener with the adjuster in an exploded view and the first piece of the body removed.
Figure 10:
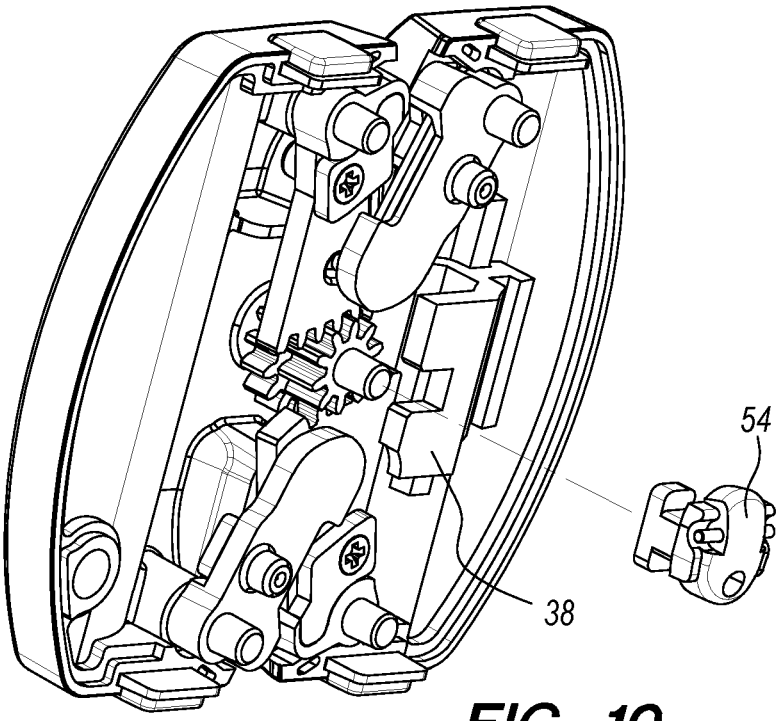
FIG. 10 is a front perspective view of the inner components of one embodiment of the adjustable sharpener with the back portion of the adjuster and the rack in an exploded view.

The adjuster 16 preferably includes a front portion 70 and a back portion 54, as shown in FIG. 8. The front portion 70 is the portion of the adjuster 16 that is configured to be grasped by the user of the sharpener 10. In one embodiment, the adjuster 16 is slidable within a recessed area 32 of the first piece 18 of the body 12. The recessed area 32 includes a plurality of notches 34, and the front portion 70 of the adjuster 16 engages one or more of the notches 34 as the front portion 70 is slid up or down within the recessed area 32. In one embodiment, one of the notches 34 receives a lip 52 on the top or bottom of the front portion 70 of the adjuster 16 (as shown in FIG. 11) to lock the adjuster 16 into place. The front portion 70 is connected to the back portion 54 of the adjuster 16 via a rod 56 that is slid through the back portion 54 and the front portion 70. As shown in FIG. 9, a spring 58 is positioned between the back portion 54 and the front portion 70 of the adjuster 16. The back portion 54 of the adjuster 16 extends through an opening 74 in the front piece 18 of the body 12 into the interior of the sharpener 10 and contacts a rack 38. In one embodiment, as shown in FIG. 10, the back portion 54 of the adjuster 16 interlocks with the rack 38 such that the adjuster 16 and the rack 38 are engaged. The rack 38 is slidably connected to a track 60 on the inner surfaces of the first and second pieces 18, 20 of the body 12. Sliding the adjuster 16 up or down within the recessed area 32 causes the rack 38 connected to the track 60 to move in the same direction.

Figure 4:
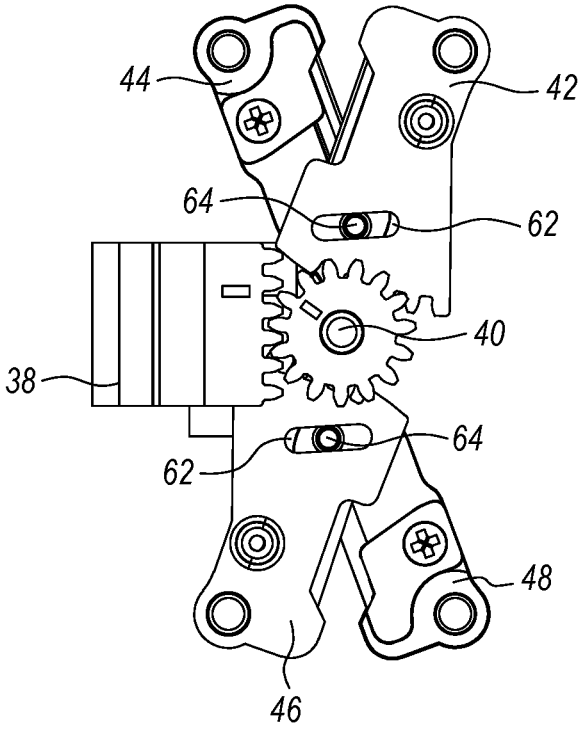
FIG. 4 is a back view of the inner components of one embodiment of the adjustable sharpener with the first piece and second piece of the body removed.
Figure 5:
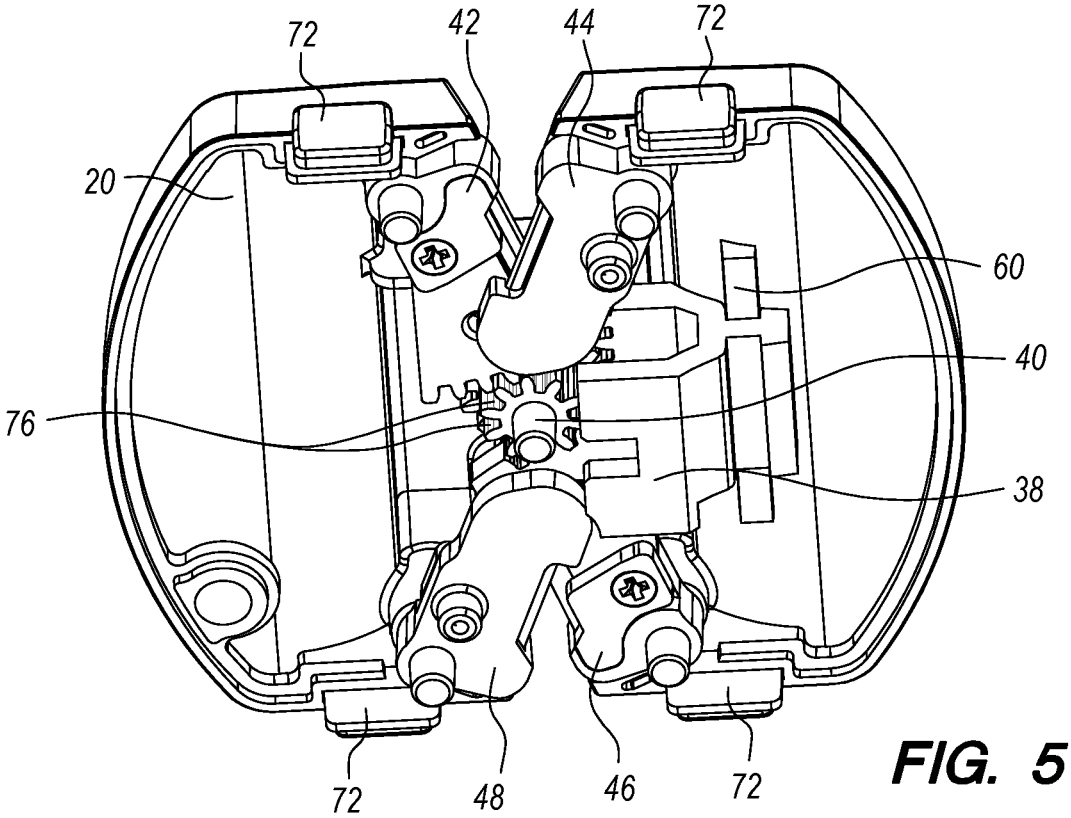
FIG. 5 is a front perspective view of the inner components of one embodiment of the adjustable sharpener with the first piece of the body removed.
Figure 6:
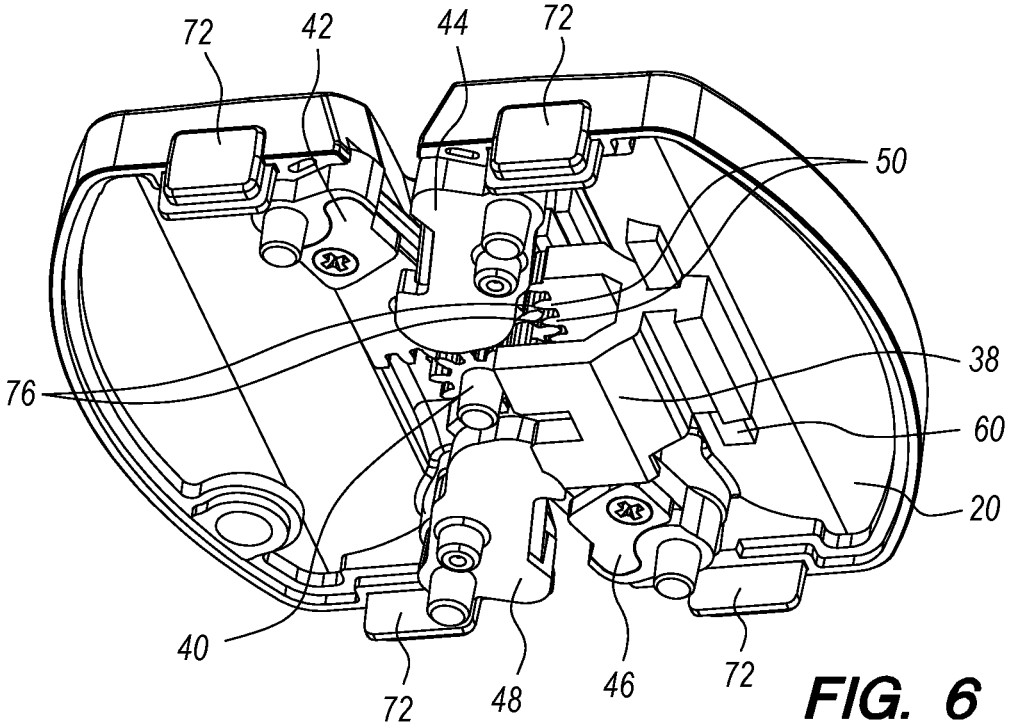
FIG. 6 is a top perspective view of the inner components of one embodiment of the adjustable sharpener with the first piece of the body removed.
Figure 7:
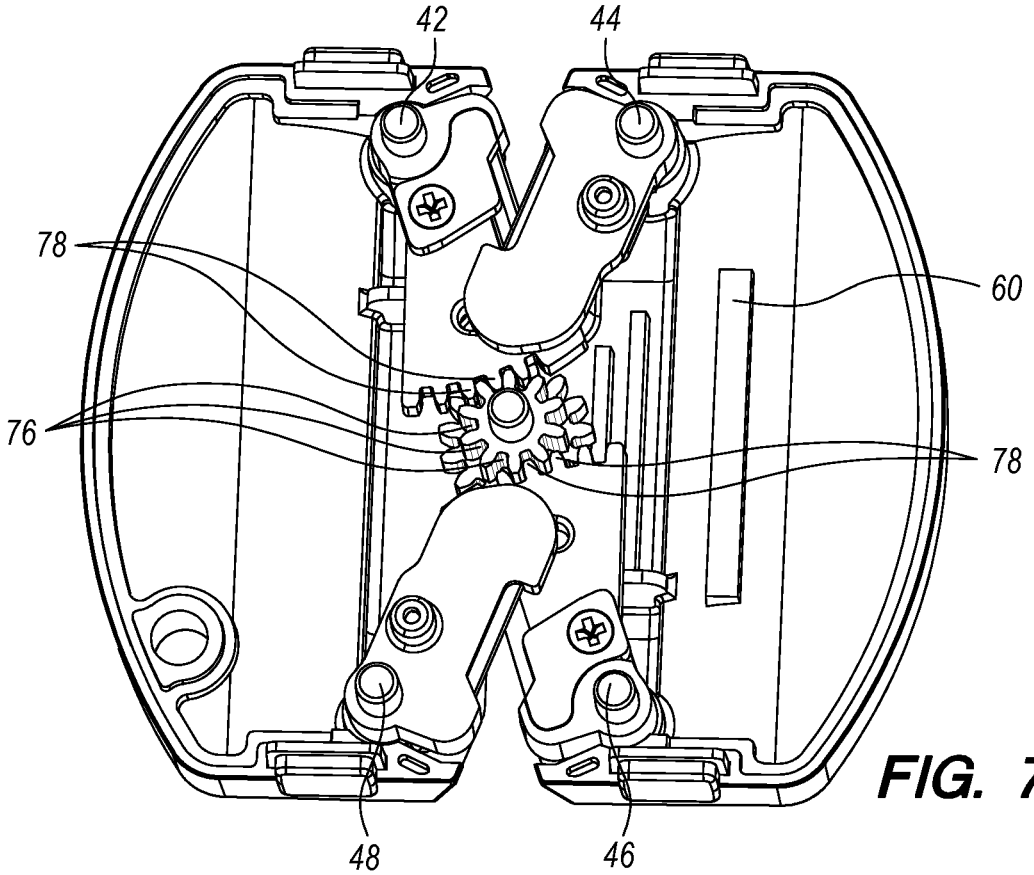
FIG. 7 is a front perspective view of the inner components of one embodiment of the adjustable sharpener with the rack removed.
Figure 13:
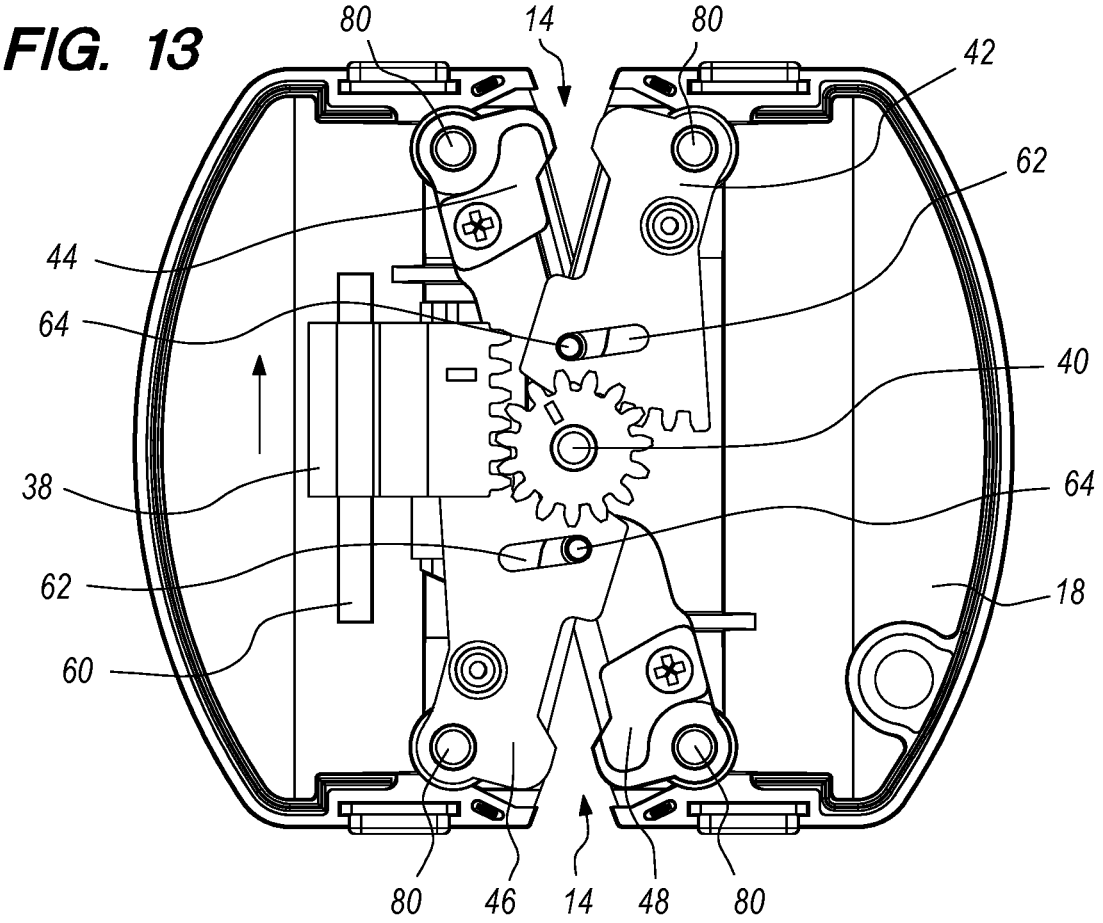
FIG. 13 is a back view of the inner components of one embodiment of the adjustable sharpener with the second piece of the body removed and the rack at an upper position on the track.
Figure 14:
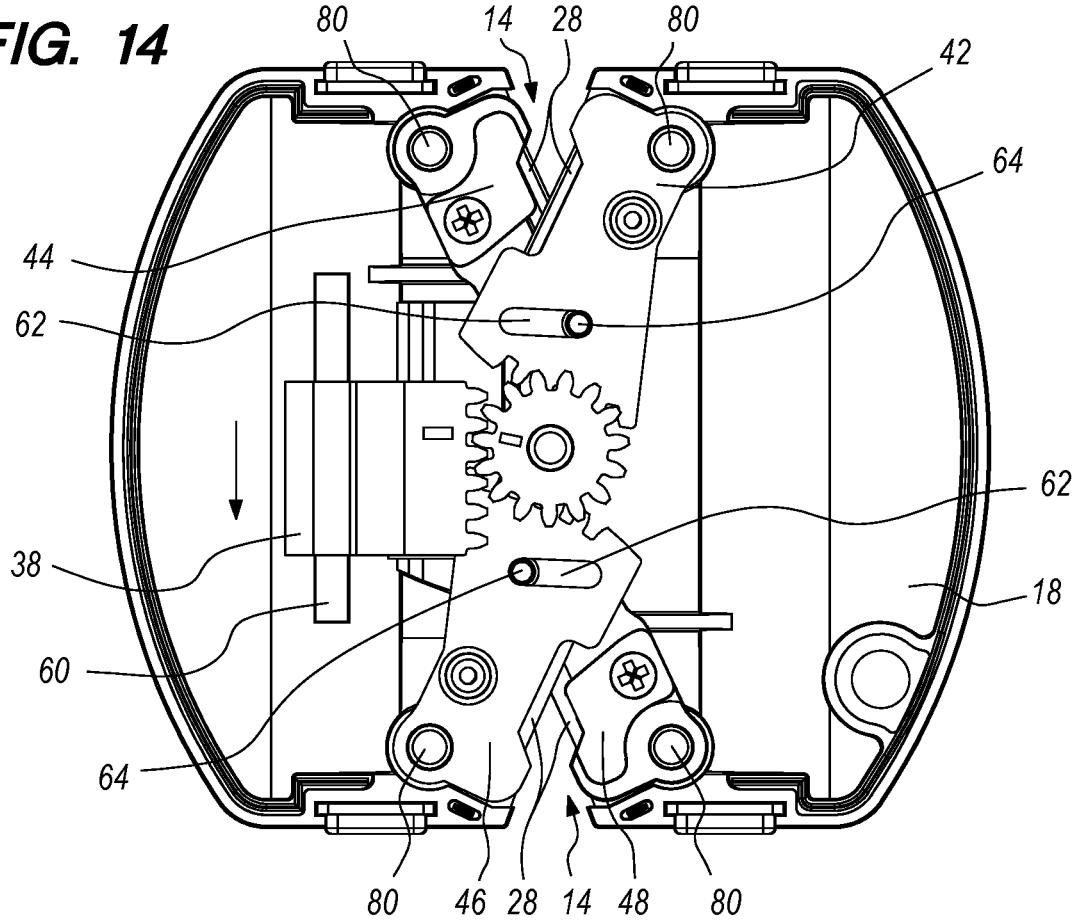
FIG. 14 is a back view of the inner components of one embodiment of the adjustable sharpener with the second piece of the body removed and the rack at a lower position on the track.

The rack 38 includes teeth 50 that engage the recesses 76 of a rotatable gear 40, as shown in FIGS. 4-6. The recesses 76 are positioned between teeth of the gear 40. The recesses 76 of the gear 40 also engage the teeth 78 of a first arm 42 and a third arm 46, as shown in FIG. 7. The teeth of the first arm 42 and the third arm 46 are preferably located at one end of the arms 42, 46. The track 60, rack 38 and gear 40 may collectively be referred to as an adjustment assembly in one embodiment. As shown in FIGS. 12-14, the first arm 42 is connected to the second arm 44, and the third arm 46 is connected to a fourth arm 48. In one embodiment, the first arm 42 includes a slot 62 that receives a pin 64 attached to the second arm 44. Similarly, the third arm 46 includes a slot 62 that receives a pin 64 attached to the fourth arm 48. The first arm 42 and the second arm, and the third arm 46 and the fourth arm 48, may also be hinged to one another. One corner of each of the arms 42, 44, 46, 48 is preferably fastened to the second piece 20 of the body of the sharpener. The point of connection between the arms and the second piece of the body is a pivot point for the arms 42, 44, 46, 48. Each of the arms 42, 44, 46, 48 is joined to an abrasive element 28 for sharpening.

In one embodiment, sliding the adjuster 16 upward causes clockwise rotation of the gear 40 via its engagement with rack 38. The clockwise rotation of the gear 40 causes counter-clockwise rotation (or pivot) of the first arm 42 and the third arm 46 at their pivot points 80, as shown in FIGS. 12-13. Because of the connection between the slot 64 of the first arm 42 and the pin 64 of the second arm 44, the counter-clockwise rotation of first arm 42 causes the second arm 44 to rotate (or pivot) clockwise at its pivot point 80. The first arm 42 can be rotated counter-clockwise until the pin 64 of the second arm 44 contacts the left side wall of the slot 62 of the first arm 42, as shown in FIG. 13. Similarly, the counter-clockwise rotation of the third arm 46 causes the clockwise rotation (or pivot) of the fourth arm 48 at its pivot point 80. The third arm 46 can be rotated counter-clockwise until the pin 64 of the fourth arm 48 contacts the left side wall of the slot 62 of the third arm 46 when considering the pin 64 and slot 62 to be at the bottom of the arms 46, 48, as shown in FIG. 13. As a result of the counter-clockwise rotation of the first arm 42 and the third arm 46, the sharpening angle formed between the abrasive elements 28 attached to the first arm 42 and the second arm 44 becomes smaller, and the sharpening angle formed between the abrasive elements 28 attached to the third arm 46 and the fourth arm 48 also becomes smaller. Thus, the adjuster 16 allows the user to manually decrease the sharpening angle between the abrasive elements in the sharpening slots 14. In addition, the distance between the top (or open end) of the sharpening slot 14 and the intersection between the abrasive elements 28 in the sharpening slot 14 becomes greater.

In that same embodiment, sliding the adjuster 16 downward causes counter-clockwise rotation of the gear 40 via its engagement with rack 38. The counter-clockwise rotation of the gear 40 causes the clockwise rotation (or pivot) of the first arm 42 and the third arm 46 at their pivot points 80, as shown in FIGS. 12 and 14. Because of the connection between the slot 64 of the first arm 42 and the pin 64 of the second arm, the clockwise rotation of first arm 42 causes the counter-clockwise rotation (or pivot) of the second arm 44 at its pivot point 80. The first arm 42 can be rotated clockwise until the pin 64 of the second arm 44 contacts the right side wall of the slot 62 of the first arm 42. Similarly, the clockwise rotation of the third arm 46 causes the counter-clockwise rotation (or pivot) of the fourth arm 48 at its pivot point 80. The third arm 46 can be rotated clockwise until the pin 64 of the fourth arm 48 contacts the right side wall of the slot 62 of the third arm 46 when considering the pin 64 and slot 62 to be at the bottom of the arms 46, 48. As a result of the clockwise rotation of the first arm 42 and the third arm 46, the sharpening angle between the abrasive elements 28 attached to the first arm 42 and the second arm 44 becomes greater and the sharpening angle between the abrasive elements 28 of the third arm 46 and the fourth arm 48 also becomes greater. Thus, the adjuster 16 allows the user to manually increase or decrease the sharpening angle between the abrasive elements 28 in the sharpening slots 14. In addition, the distance between the top (or open end) of the sharpening slot 14 and the intersection between the abrasive elements 28 in the sharpening slot 14 is reduced.

In an alternative embodiment or depending on whether the sharpener is being viewed from the front or the back, sliding the adjuster 16 upward causes counter-clockwise rotation of the gear and sliding the adjuster downward causes clockwise rotation of the gear. In that embodiment, the movements of the various components are opposite of the movements of those components described above.

As shown in FIG. 1, the body 12 of the sharpener 10 also include an opening 66 that extends through the first piece 18 and the second piece 20. A lanyard (not shown) may be attached to the opening 66. A cover 68 is attached to the first and second sections 22, 24 of each of the first piece 18 and the second piece of the body 12 to aid the user in safely gripping the sharpener 10 during use.

Figure 15:
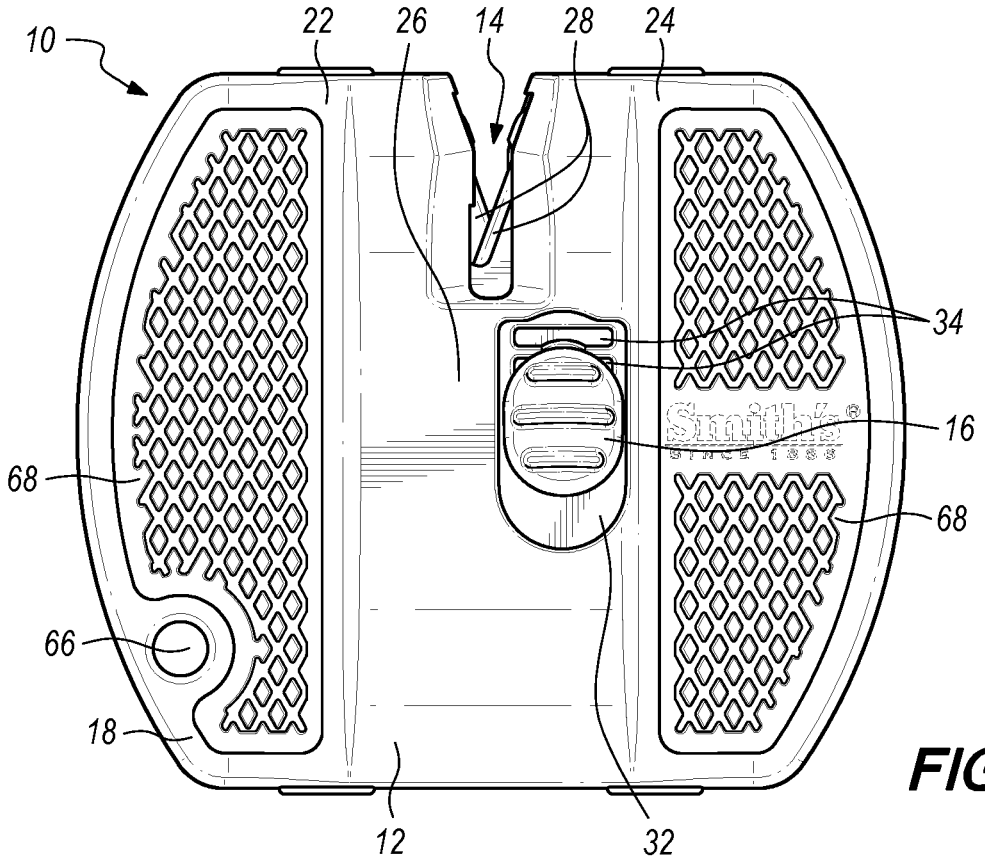
FIG. 15 is a front view of an alternative embodiment of the adjustable sharpener.

While the adjustable sharpener of the present invention has been described with reference to four arms 42, 44, 46, 48 and two sharpening slots 14, the present invention is not so limited. In an alternative embodiment, the adjustable sharpener includes only two arms 42, 44 and one sharpening slot 14 (as shown in FIG. 15), but the sharpener operates in the same manner as described above.

In an alternative embodiment, the adjuster 16 is capable of being rotated to adjust the sharpening angle. In that particular embodiment, the rotational movement of the adjuster 16 causes the rack 38 to move up or down on the track 60. The sharpening angle is then adjusted in the same manner as described above.

The present invention has been described with reference to certain preferred and alternative embodiments that are intended to be exemplary only and not limiting to the full scope of the present invention as set forth in the appended claims.

We claim:

1. An adjustable sharpener comprising:

a body comprising a first sharpening slot and a second sharpening slot;

a first arm, wherein said first arm is connected to a first abrasive element;

a second arm, wherein said second arm is connected to a second abrasive element, wherein said first abrasive element and said second abrasive element are positioned in said first sharpening slot, wherein said first arm has a first elongated slot and said second arm has a first pin, wherein said first arm is connected to said second arm via said first elongated slot receiving said first pin;

a third arm, wherein said third arm is connected to a third abrasive element, a fourth arm, wherein said fourth arm is connected to a fourth abrasive element, wherein said third abrasive element and said fourth abrasive element are positioned in said second sharpening slot, wherein said third arm is connected to said fourth arm;

an adjuster; and an adjustment assembly connected to said adjuster, said first arm and said third arm, wherein linear movement of said adjuster along an outer surface of said body causes rotational movement of said first arm about a pivot point located away from said first elongated slot and said first pin and causes rotational movement of said third arm.

2. The adjustable sharpener of claim 1, wherein said adjustment assembly comprises a rack connected to a gear.

3. The adjustable sharpener of claim 1, wherein a portion of said adjuster is slidable on said body.

4. The adjustable sharpener of claim 1, wherein said first sharpening slot is opposite said second sharpening slot.

5. The adjustable sharpener of claim 1, wherein said body comprises a plurality of feet.

6. The adjustable sharpener of claim 1, wherein said body comprises a first piece and a second piece.

7. The adjustable sharpener of claim 1, wherein said third arm comprises a second elongated slot.

8. The adjustable sharpener of claim 7, wherein said fourth arm comprises a second pin.

9. The adjustable sharpener of claim 8, wherein said second pin is received by said second elongated slot.

10. The adjustable sharpener of claim 1, wherein at least a portion of said adjuster is positioned between said first sharpening slot and said second sharpening slot.

11. The adjustable sharpener of claim 2, wherein said rack comprises a plurality of teeth and recesses.

12. The adjustable sharpener of claim 2, wherein said gear comprises a plurality of teeth and recesses.

13. The adjustable sharpener of claim 2, wherein said gear is connected to said first arm and said third arm.

14. The adjustable sharpener of claim 1, wherein a sharpening angle is formed between said first abrasive element and said second abrasive element, wherein said rotational movement of said first arm increases or decreases said sharpening angle.

15. An adjustable sharpener comprising:

a body comprising a first sharpening slot;

a first arm, wherein said first arm is connected to a first abrasive element;

a second arm, wherein said second arm is connected to a second abrasive element, wherein said first abrasive element and said second abrasive element are positioned in said first sharpening slot, wherein said first arm has an elongated slot and said second arm has a pin, wherein said first arm is connected to said second arm via said elongated slot and said pin;

an adjuster; and an adjustment assembly connected to said adjuster and said first arm, wherein linear or rotational movement of said adjuster causes rotational movement of said first arm about a first pivot point, wherein said first pivot point is spaced toward an open end of said first sharpening slot away from the connection between said elongated slot of said first arm and said pin of said second arm.

* * * * *